US005603340A

United States Patent [19]

Gueret

[11] Patent Number: 5,603,340

[45] Date of Patent: Feb. 18, 1997

[54] POWDERED PRODUCT PACKAGING AND DISPENSING UNIT

[75] Inventor: Jean-Louis Gueret, Paris, France

[73] Assignee: L'Oreal, France

[21] Appl. No.: 427,956

[22] Filed: Apr. 26, 1995

[30] Foreign Application Priority Data

Apr. 27, 1994 [FR] France ..... 94-05088

[51] Int. Cl.[6] ..... A45D 33/00

[52] U.S. Cl. ..... 132/293; 132/298; 132/306; 132/307; 132/317

[58] Field of Search ..... 132/293, 298, 132/294, 306, 307, 317, 295

[56] References Cited

U.S. PATENT DOCUMENTS

| | | | |
|---|---|---|---|
| 1,616,381 | 2/1927 | MacDougall | 132/298 |
| 1,616,696 | 2/1927 | MacDonald | 132/298 |
| 1,642,780 | 9/1927 | Kole et al. | 132/298 |
| 1,804,943 | 5/1931 | Maillard . | |
| 2,035,290 | 3/1936 | Bauer . | |

FOREIGN PATENT DOCUMENTS

| | | |
|---|---|---|
| 528705A1 | 6/1992 | European Pat. Off. . |
| 627732 | 10/1927 | France . |
| 403219 | 12/1933 | United Kingdom . |

OTHER PUBLICATIONS

English language abstract of Japanese Patent No. 2,049,717.

*Primary Examiner*—Gene Mancene
*Assistant Examiner*—Pedro Philogene
*Attorney, Agent, or Firm*—Finnegan, Henderson, Farabow, Garrett & Dunner, L.L.P.

[57] ABSTRACT

A unit is disclosed for packaging and dispensing a loose powder product. The unit includes a case provided with a lid and a receptacle containing the product. A screen capable of being deformed during the action of taking up the powder is disposed on the powder. An elastically deformable member situated on a base of the receptacle decompacts the powder during dispensing and thus allows for take up of a uniform quantity of powder.

28 Claims, 3 Drawing Sheets

POWDERED PRODUCT PACKAGING AND DISPENSING UNIT

BACKGROUND OF THE INVENTION

1. Field of the Invention

The present invention relates to a unit or apparatus for packaging and dispensing a loose powder product. More particularly, the present invention relates to a package and dispenser for a pulverulent make-up product, regardless of whether the product is colored. In addition, the invention relates to a powder compact for make-up including the packaging and dispensing unit.

2. Description of the Related Art

Conventional packaging units include a case having a lid and a container for powdered material. When loose powder is removed or taken up from these packaging units, powder remaining in the container settles in a base of the container. This settlement takes place when either a powder puff and screen or human fingers repeatedly press the powder within the container as it is dispensed from the unit. After a period of time, powder settlement renders it difficult to take up uniform and homogeneous quantities of powdered material or make-up from the unit, since the powder is compacted in an aggregate at the base of the container.

Moreover, dispensing or taking up of powdered material is difficult or even impossible when it is compacted. Thus, the useful life of a conventional packaging unit or powder compact is shortened. Because this unit is disposed of prematurely, overall cost increases.

To prevent powder product compacting, a unit may include a screen having very large mesh openings. However, this large mesh screen renders it difficult or impossible to prevent a powder puff from becoming heavily loaded with the powdered product.

Some make-up powders have a small granulometric size to provide a make-up product that is finer and more homogeneous. However, as the powder becomes finer, it undesirably compacts more readily and becomes difficult to take up or dispense.

Some prior attempts to dispense and package a powdered product have had only limited success. For example, GB-A-0 403 219 discloses a unit for dispensing powder wherein a bellows directs air through powder stored between two rigid screens. Thus, the powder becomes aerated and passes through one of the screens so that a user can take up the powder with a powder puff.

Unfortunately, this aeration is unsatisfactory, because channels form only in limited portions of the powder where the air passes, while other portions of the powder remain compacted. In addition, when the powder is taken up a cloud of volatile powder forms which may soil the surroundings or cause respiratory problems for a user. Moreover, the device impregnates a powder puff with powder in an incomplete manner requiring a user to load the puff several times in succession to charge the puff adequately with powder.

SUMMARY OF THE INVENTION

A general object of the present invention is to provide a unit or apparatus for packaging and dispensing a loose powder product that substantially obviates one or more of the limitations of the related art.

Another object of the invention is to provide a device for permitting homogeneous take up or dispensing of powders, including very fine powders, such that a make-up powder may be applied uniformly to the skin.

A further object of the invention is to provide a unit that allows for powder to be taken up or dispensed until all of the powder is removed and the unit is empty.

To achieve these and other objects in accordance with the invention, as embodied and broadly described herein, the invention includes a unit for packaging and dispensing a loose powder product. A case is provided with a lid and a receptacle containing the product, the receptacle having a base. A screen capable of being deformed during the action of taking up the powder is disposed on the powder. Elastically deformable impact damping and/or aerating means situated on the base of the receptacle decompact the powder, and thus allow for take up of a uniform quantity of powder. This impact damping and/or aerating means is capable of deformation during the action of taking up the powder.

In another aspect, the elastically deformable impact damping and/or aerating means may include a patch of foam with open or half-open cells, a bellows, or a corrugated component.

In another aspect, the invention includes a foam patch or a bellows have bosses or corrugations. This allows for random compression of the foam patch or the bellows to promote decompacting of the powder. Alternatively, these bosses or corrugations may be formed on the base of the receptacle.

In yet another aspect of the invention, the foam of the patch is preferably fabricated from porous thermoplastic materials, such as, polyether foams, polyurethane foams, latex foams, and elastomeric foams. These foam patches may have a volume of open cells ranging from 30% to 50%, or from 30% to 40%, of a total volume of the foam patch.

In still another aspect of the invention, the cells of the patch of foam may have openings with diameters ranging from 0.005 mm to 2 mm, and preferably ranging from 0.1 mm to 0.5 mm.

In another aspect, the powder product has an average granulometric size ranging from 1 μm to 100 μm, and preferably ranging from 6 μm to 20 μm.

In another aspect, a filter is disposed between the impact damping means and the powder. The filter may be joined or, alternatively, not joined to the impact-damping means. This filter may be fabricated from a woven or nonwoven assembly of natural, synthetic, or metal fibers, a screen, a thermoplastic foam material, or a metal grill.

In another aspect, the screen disposed on the powder may include a mesh having a mesh size ranging from 5 μm to 600 μm and preferably from 30 μm to 200 μm.

In still another aspect, the invention includes a make-up compact including the unit of the invention.

In a further aspect, the invention includes an apparatus including means for decompacting powder within the receptacle in response to the powder being compressed. The decompacting means may include a resilient member positioned within the receptacle.

In yet another aspect, the invention includes an apparatus including means for drawing air through the powder when a pressing force is released from a flexible wall.

Additional features, objects, and advantages of the invention will be set forth in part in the description which follows, and in part will be evident from the description, or may be learned by practice of the invention. The objectives and advantages of the present invention will be realized and obtained by the apparatus particularly pointed out in the following written description and the appended claims, as well as in the accompanying drawings.

It is to be understood that both the foregoing general description and the following detailed description are exemplary only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
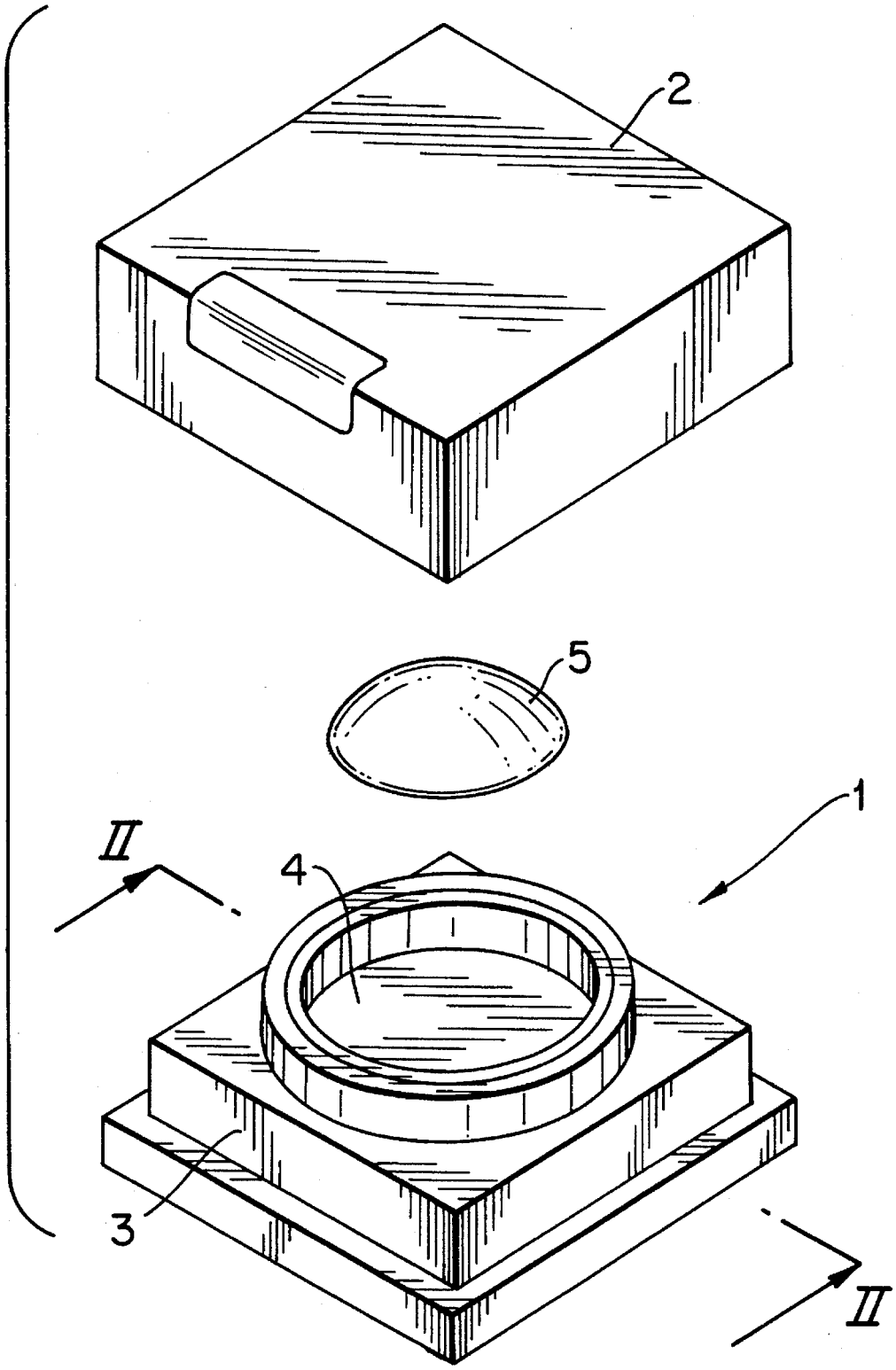
FIG. 1 is a perspective view of first embodiment of the invention illustrating components in a partially disassembled form.
Figure 2:
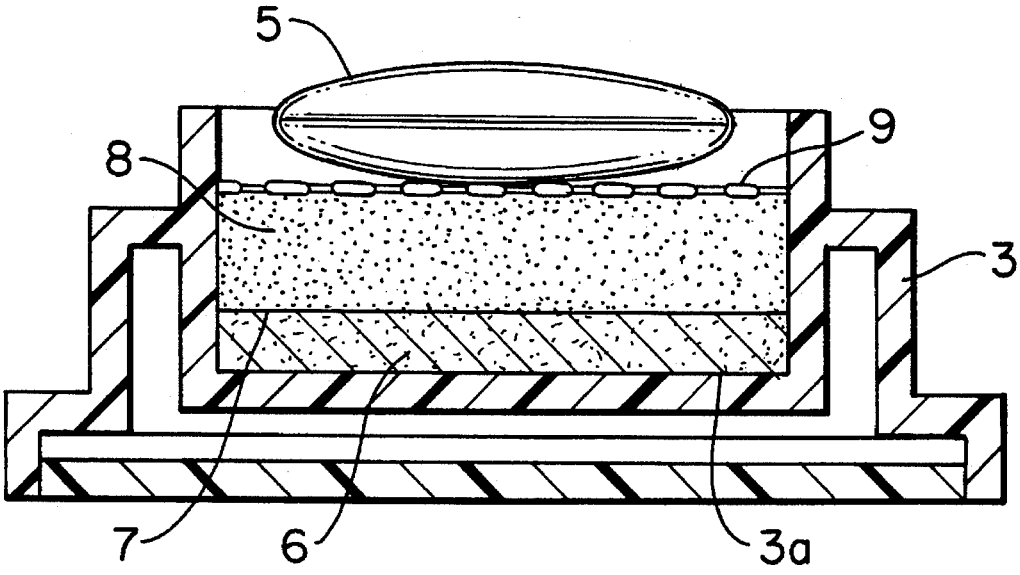
FIG. 2 is a partial cross-section view taken on line II—II of FIG. 1 with a hollow stopper and a lid being removed and a powder puff being placed on a screen.

As shown in FIGS. 1 and 2, in a first embodiment of the invention a unit or apparatus includes a case 1 having a lid 2 capable of being fit on a receptacle 3. The case 1 may be fabricated from a rigid plastic material and shaped, for example, in a parallelepiped shape. As shown in FIG. 1, a hollow stopper 4 fabricated from a material similar to that of the receptacle 3 removably fits into an opening of the receptacle 3 to protect powder 8 in the receptacle 3 from humidity. To separate a powder puff 5 from the powder 8, the powder puff 5 may be placed within a top cylindrical portion of the stopper 4 when the lid 2 closes the case 1.

As shown in FIG. 2, an elastically deformable or resilient member 6 is placed on a base 3*a* of the receptacle 3 to provide an aerator and/or impact dampener, as described below. In a preferred embodiment, the member 6 is a foam patch fabricated from polyurethane and has a pore diameter of 0.5 mm. The member 6 may also include a patch of foam having open or half-open cells fabricated from porous thermoplastic materials, such as, polyether foams, polyurethane foams, latex foams, and elastomeric foams. This foam patch may have a volume of open cells ranging from 30% to 50%, or from 30% to 40%, of a total volume of the foam patch. In addition, the cells of the foam patch may have openings with diameters ranging from 0.005 mm to 2 mm, and preferably ranging from 0.1 mm to 0.5 mm.

Optionally, a non-return or one-way filter 7 is disposed on the elastically deformable member 6 between the member 6 and the powder 8. This filter 7 may be joined to the member 6, for example by bonding. Alternatively, the filter 7 is not joined to the member 6. The optional filter 7 prevents the powder 8 from being drawn towards the member 6 when the member 6 compresses or expands, as described below. Also, this filter 7 physically separates the powder 8 from the member 6 during this compression or expansion.

The filter 7 may be fabricated from many different types of materials. For example, the filter 7 may be an assembly of woven or nonwoven natural, synthetic or metallic fibers, a screen, a foam made of a thermoplastic material, or a metallic grill. Preferably, the filter 7 is a screen made from a flexible plastic material having a mesh size or aperture diameter of approximately 100 μm. Although the material of the filter 7 is preferably flexible to follow any deformation of the member 6 when powder is taken up, other materials are possible. For example the filter 7 may be a screen made from a rigid plastic material, such as polyethylene or polyvinyl chloride.

In a preferred embodiment, the filter 7 is a flocked first foam having very narrow pore openings, for example, less than 0.02 mm in diameter, and the member 6 is a second foam having large cells, for example larger than 0.5 mm in diameter.

The powder 8 contained within the receptacle 3 is located either directly on the filter 7, or, if the filter 7 is omitted, directly on the member 6. In contrast to the prior art, the present invention dispenses fine powder easily. The powder product 8 has an average granulometric size or spherical diameter ranging from 1 μm to 100 μm, and preferably ranging from 6 μm to 20 μm. More preferably, the granulometric size of the powder 8 ranges from 1 μm to 15 μm. In addition, the powder 8 may have a granulometric size ranging up to 1 mm.

In a preferred embodiment, the powder 8 is a make-up or cosmetic product, colored, for example with a pale color. However, the receptacle 3 may contain many other types of colored or uncolored powdered or non-powdered substances without departing from the scope of the invention.

An apertured wall or screen 9 connected to the receptacle 3 adjacent to an opening of the receptacle 3 is disposed on the powder product 8 to cover the powder 8. When the powdered product 8 is taken up or dispensed from the unit, the apertures or openings of the screen 9 control a fine and more homogeneous distribution of the powder 8 onto an applicator. A size, such as the diameter, of the mesh of the screen 9 may range from 5 μm to 600 μm, and is preferably from 30 μm to 200 μm. In a preferred embodiment, the powder 8 has a granulometric size of approximately 12 μm, and the screen 9 has a mesh size of approximately 200 μm.

Preferably, the screen 9 is formed from a flexible material that is capable of deforming toward the powder 8 in the receptacle 3 when the powder 8 is taken up from or dispensed from the unit. However, the screen 9 may be fabricated from a rigid plastic material.

As shown in FIG. 2, after the lid 2 and stopper 4 are removed from the case 1, a powder puff 5 is placed on the screen 9. To take up or dispense a homogeneous quantity of the powder 8, a user presses the screen 9, for example, with the powder puff 5. This pressure deforms the screen 9 toward the powder 8 within the receptacle 3. As the screen 9 deforms or flexes, the powder 8 passes through the mesh openings or apertures of the screen 9 to impregnate the powder puff 5.

When the user presses the screen 9, the powder 8 positioned beneath the screen 9 is compressed. In addition, the elastically deformable or resilient member 6 compresses to dampen the impact of the pressing. After the pressing force on the screen 9 is discontinued, the member 6 returns to its initial shape. Thus, air is drawn or propelled through the powder 8 in the receptacle 3 after passing through the screen 9. In addition, this resilient member 6 expansion decompacts the powder 8 within the receptacle 8 to ensure a uniform distribution of powder 8 onto the powder puff 5.

Thus, the member 6 simultaneously decompacts and aerates the powder particles 8. The member 6 compresses when a mechanical pressure is exerted thereon and decompresses when the mechanical pressure is interrupted. The decompression of the member 6 produces a return or expansion to its initial shape. This resilient expansion propels or draws air into the powder 8, to aerate the powder 8. The aeration occurs each time the powder 8 is taken-up or dispensed and hence during each use. The thickness of the member 6 depends on the quantity of air that one wishes to blow into the powder 8 and, of course, on the thickness of the case 1.

In addition to the aeration of the powder 8, the powder particles become displaced when the member 6 elastically expands. Thus, the powder puff 5 or other applicator has a more uniform and more homogeneous powder distribution thereon.

After powder 8 is dispensed or taken up from the receptacle 3 through screen 9, the powder puff 5 impregnates with the powder 8. Then, a user may remove the impregnated powder puff 5 to apply the powder 8 to a surface. Although the powder puff 5 is described herein as the applicator or "take-up" element for the powder 8, other applicators are possible. For example, a brush or even a finger of the user may replace the powder puff 5.

In an embodiment not shown in the drawings, when the applicator or take-up element is a brush, the brush may be fixed to the lid 2 of the case 1. In a closed position of the lid 2, the brush directly contacts the screen 9 disposed on the powder 6, and thus compresses the member 6. When the lid 2 of the case 1 is opened, the member 6 decompresses to ventilate the powder by aeration and deposit powder 8 on a brush which is immediately ready for use.

Figure 3:
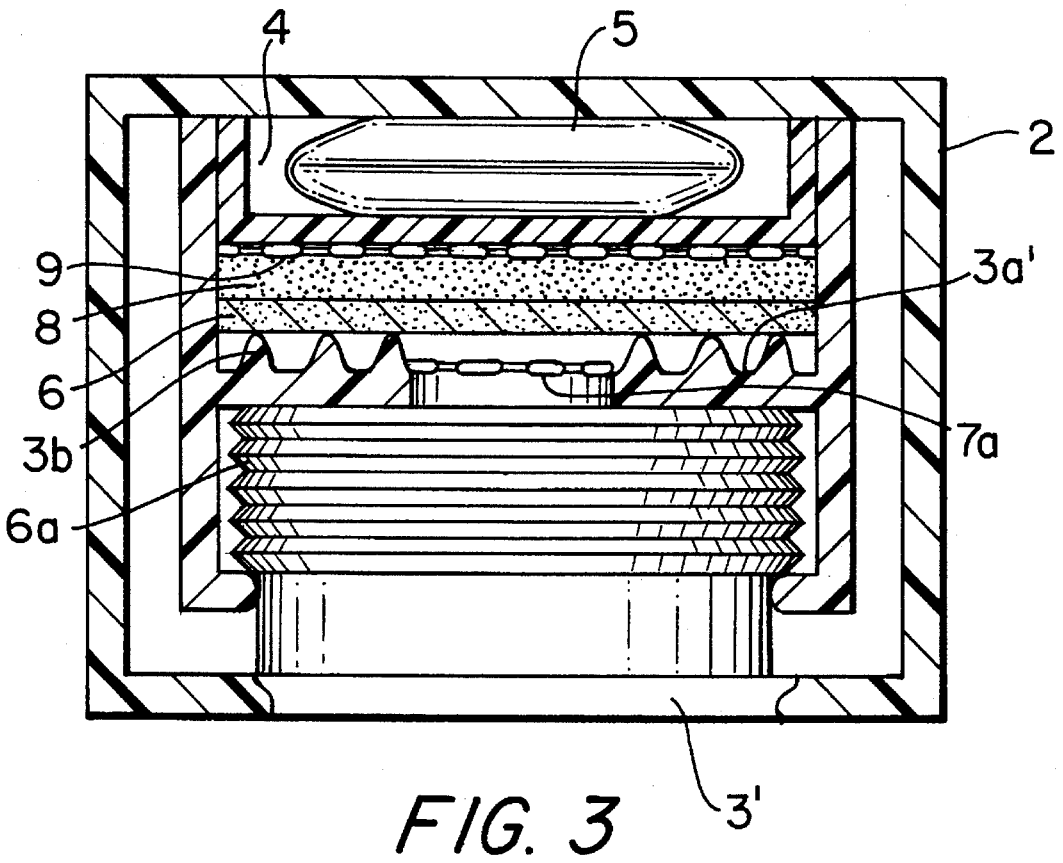
FIG. 3 is a partial cross-section view, similar to that of FIG. 2, of a second embodiment of the invention including a hollow stopper and a lid.

FIG. 3 illustrates another embodiment of the invention including a modified receptacle 3' and base **3*a'* configured slightly different from the receptacle 3 and base 3*a*, respectively, shown in the embodiment of FIG. 2. As indicated with like reference numerals, the embodiment of FIG. 3 includes same or similar elements to those of the embodiment of FIGS. 1 and 2**.

As shown in FIG. 3, a bellows 6a is positioned within the receptacle 3'. This bellows **6*a* is in fluid communication with the powder 8 in the receptacle 3' through both a through-hole in the base 3*a'* and the member 6. The bellows 6*a*** may be fabricated from an elastic or resilient material that allows the bellows to expand to an original state after being compressed.

As shown in FIG. 3, the member 6 rests on a multiplicity of protuberances, bosses, or corrugations **3*b* formed on the base 3*a'*. When the powder 8 is taken up or dispensed, these protuberances 3*b* produce a random deformation of the foam member 6. Thus, when a user takes up a dose of the powdered product 8, the member 8 expands to decompact the powder 8**.

Preferably, the open end of the bellows **6*a* is joined to a one-way filter 7*a* to prevent the bellows 6*a* from being filled with the powder 8. The material for this filter 7*a* may be identical to the material for the filter 7 described above. Preferably, the filter 7*a*** is a mesh with openings having a diameter smaller than that of the powder particles.

When an axial force, such as the pressing force applied to the screen 9 during powder 8 take-up, contracts bellows **6*a*, air is forced from the bellows 6*a*. This air passes into the powder 8 through both the filter 7*a* and member 6. Thus, the bellows 6*a* dampens impact of the powder 8 and aerates the powder 8. This is in addition to the above described functioning of member 6**.

Figure 4:
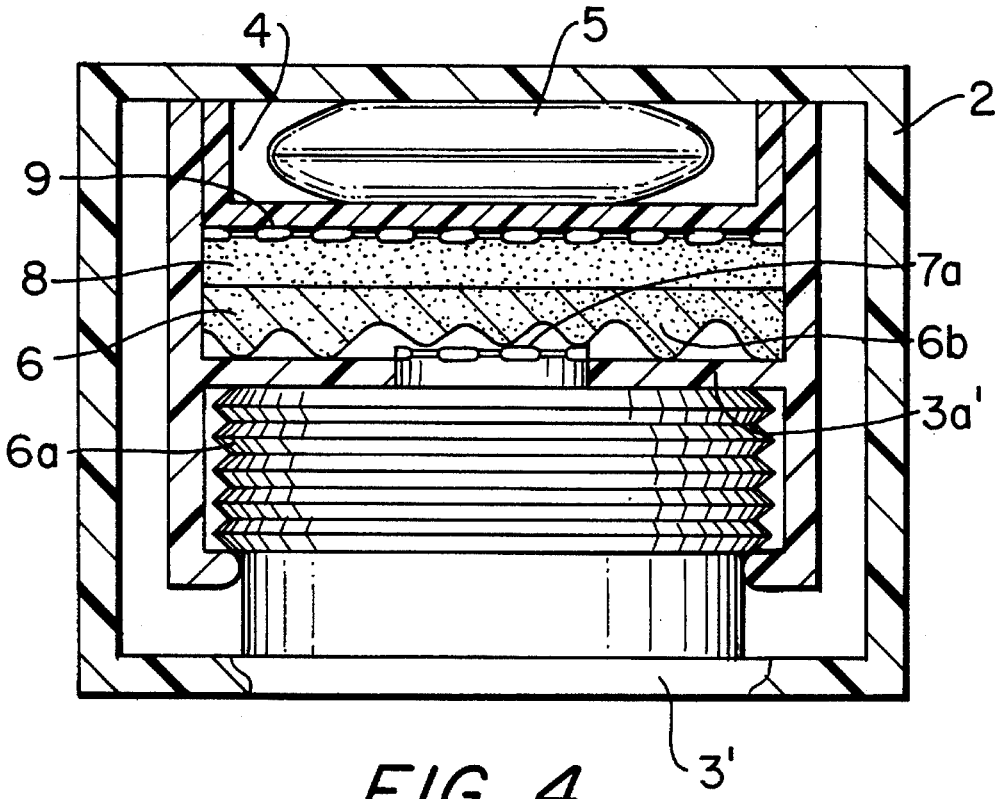
FIG. 4 is a partial cross-section view, similar to that of FIG. 3, of a third embodiment of the invention.

FIG. 4 illustrates an embodiment of the invention similar to that of FIG. 3. Rather than the protuberances **3*b*, this embodiment includes a multiplicity of bosses or corrugations 6*b* to randomly deform the interface of the member 6 and the powder 8**.

Figure 5:
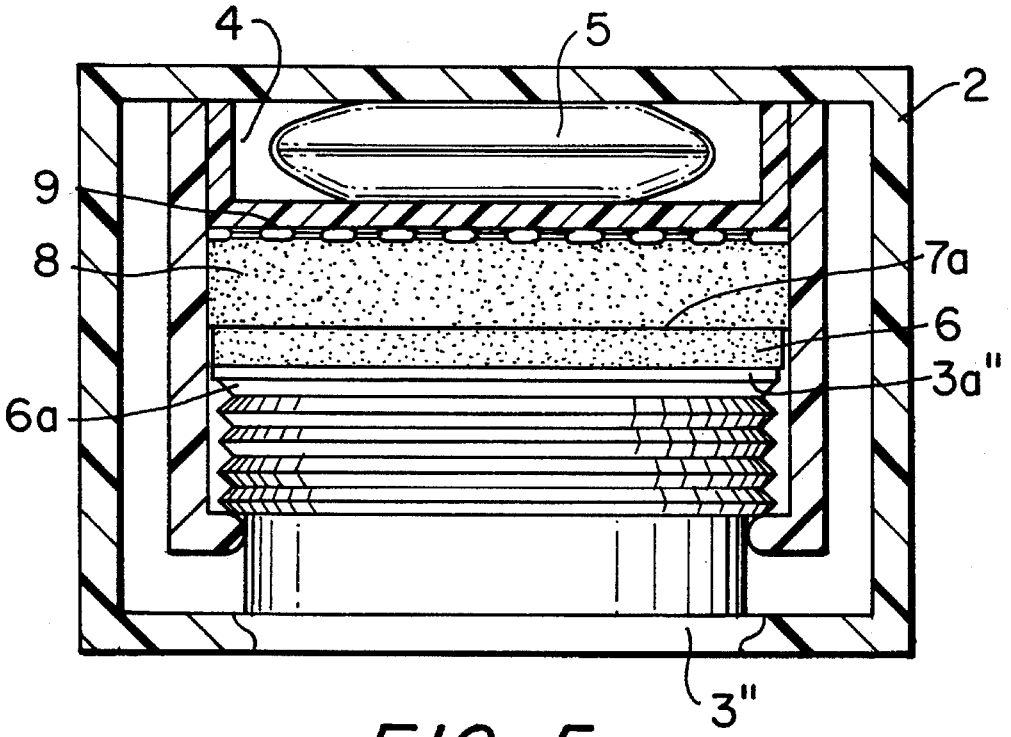
FIG. 5 is a partial cross-section view, similar to that of FIG. 3, of a fourth embodiment of the invention.

FIG. 5 depicts another embodiment of the invention similar to that of FIG. 3. This embodiment includes a base **3*a"* which is movable within a receptacle 3", rather than being attached to a wall of the receptacle 3". One side of the base 3*a"* is fixed to the superior extremity of the bellows 6*a*, while an opposite side is linked to the deformable foam patch member 6. Thus, the base 3*a"* and the foam patch 6 act as a plunger to push the powder 8 toward the screen 9 when an axial force is applied to the receptacle 3" Air propelled by the bellows 6*a*, in conjunction with the action of the deformable foam patch, uniformly decompacts the powder 8. After having passed through the screen 9, a quantity of powder 8 can be taken up by the powder puff 5** in a uniform and homogeneous manner.

As described above, an impact dampening means, in the form of a member 6, a bellows **6*a*, a corrugation, or the like, has the function of propelling air into the powder 8 by an elastic movement. This takes place without forming a cloud of powder 8**.

The above-described unit for packaging and/or dispensing has particular application in the field of make-up. In particular, the case 1, lid 2, and receptacle 3, 3', 3" of the unit may constitute a powder compact for skin make-up. In addition, the powder may be pale or have another color according to the nature of the make-up desired. Thus, the invention includes a make-up powder compact including a packaging and dispensing unit described above.

Although the invention has particular application in a make-up powder compact, it goes without saying that the invention has a much broader general scope, as indicated above.

It will be apparent to those skilled in the art that various modifications and variations can be made in the packaging and dispensing apparatus of the present invention without departing from the spirit or scope of the invention. Other embodiments of the invention will be apparent to those skilled in the art from consideration of the specification and practice of the invention disclosed herein. It is intended that the present invention cover the modifications and variations of this invention provided they come within the scope of the appended claims and their equivalents.

What is claimed is:

1. A packaging and dispensing unit for a loose powder product, the unit comprising:

a case having a lid and a receptacle including a receptacle portion for receiving the powder product, the receptacle having a base and a wall extending from the base to an opening in the receptacle;

a screen secured to the wall of the receptacle, the screen being configured for being deformed when the powder product is dispensed and for contacting the powder product when the powder product is received in the receptacle portion; and elastically deformable impact damping and/or aerating means situated in the receptacle between the base and the receptacle portion, the elastically deformable impact dampening and/or aerating means being capable of deforming when the powder product is dispensed.

2. The unit of claim 1, wherein the elastically deformable impact damping and/or aerating means includes one of a group consisting of bosses and corrugations extending towards the base.

3. The unit of claim 1, wherein the base includes one of a group consisting of bosses and corrugations extending towards the elastically deformable impact damping and/or aerating means.

4. The unit of claim 1, further comprising a flexible filter positioned between the elastically deformable impact damping and/or aerating means and the receptacle portion.

5. The unit of claim 1, wherein the elastically deformable impact damping and/or aerating means is selected from one of a group consisting of a patch of open cell foam and a patch of half-open cell foam.

6. The unit of claim 5, wherein the patch of open cell foam is fabricated from one of a group consisting of polyether, polyurethane, latex, and elastomeric material.

7. The unit of claim 5, wherein a volume of open cells in the patch of open cell foam ranges from 30% to 50% of a total volume of the patch of open cell foam.

8. The unit of claim 4, wherein the flexible filter is selected from one of a group consisting of a woven fiber assembly, a nonwoven fiber assembly, a screen, and a metal grill.

9. The unit of claim 5, wherein the patch of open cell foam and the patch of half open cell foam include cells having openings ranging from 0.005 mm to 2 mm in diameter.

10. The unit of claim 5, wherein the patch of open cell foam and the patch of half open cell foam include cells having openings ranging from 0.1 mm to 0.5 mm in diameter.

11. The unit of claim 1, wherein the screen includes a mesh having a mesh size ranging from 5 μm to 600 μm.

12. The unit of claim 1, wherein the screen includes a mesh having a mesh size ranging from 30 μm to 200 μm.

13. The unit of claim 1, further comprising a powder puff placed on the screen.

14. The unit of claim 4, wherein the filter is joined to the elastically deformable impact damping and/or aerating means.

15. The unit of claim 1, further comprising a bellows having an interior in fluid communication with the receptacle portion for forcing air through the powder product received in the receptacle portion.

16. The unit of claim 15, wherein an open end of the bellows is in fluid communication with the elastically deformable impact damping and/or aerating means.

17. A make-up powder compact comprising:

a case having a lid and a receptacle containing powder product, the receptacle having a base and a wall extending from the base to an opening in the receptacle;

a screen secured to the wall of the receptacle, the screen being capable of being deformed when the powder product is dispensed and being disposed on the powder product; and elastically deformable impact damping and/or aerating means situated in the receptacle between the base and the powder product, the elastically deformable impact dampening and/or aerating means being capable of deforming when the powder product is dispensed.

18. The unit of claim 17, wherein the powder product has a granulometric size ranging from 1 μm to 100 μm.

19. The unit of claim 17, wherein the powder product has a granulometric size ranging from 6 μm to 20 μm.

20. The unit of claim 17, wherein the elastically deformable impact damping and/or aerating means forces air through the powder product within the receptacle.

21. A powder dispensing apparatus comprising:

a receptacle containing powder between a base and an opening of the receptacle;

a wall arranged adjacent the opening of the receptacle, the wall having at least one aperture for dispensing the powder; and a resilient foam member positioned within the receptacle between the powder and the base, such that when both the powder and the resilient foam member become compressed the resilient foam member expands to decompact the powder.

22. The apparatus of claim 21, further comprising a bellows having an interior in fluid communication with the powder contained in the receptacle for forcing air through the powder.

23. The apparatus of claim 22, further comprising a filter arranged to substantially obstruct passage of the powder into the bellows.

24. The apparatus of claim 21, further comprising a filter positioned within the receptacle between the powder and the resilient foam member, the filter substantially obstructing passage of the powder into the resilient foam member.

25. The apparatus of claim 21, further comprising an applicator arranged adjacent to the wall for applying onto a surface powder dispensed from the receptacle.

26. The apparatus of claim 22, wherein an open end of the bellows is in fluid communication with the resilient foam member.

27. A powder dispensing apparatus comprising:

a receptacle containing powder and having a base and a wall extending from the base to an opening of the receptacle;

a flexible wall secured to the wall of the receptacle adjacent the opening, the flexible wall having at least one aperture for dispensing the powder and being capable of compressing the powder within the receptacle when a pressing force is applied to the flexible wall; and means, positioned within the receptacle between the base and the powder, for drawing air into the aperture and through the powder when the pressing force is released from the flexible wall.

28. The apparatus of claim 27, wherein the air drawing means is a resilient foam member.

* * * * *